US011441265B2

(12) United States Patent
Allison et al.

(10) Patent No.: US 11,441,265 B2
(45) Date of Patent: Sep. 13, 2022

(54) VENT STACK TEMPERATURE AS A FEEDFORWARD VARIABLE FOR SMELT DISSOLVING TANK TTA CONTROL

(71) Applicant: FPInnovations, Pointe-Claire (CA)

(72) Inventors: Bruce James Allison, Vancouver (CA); Wei Ren, Richmond (CA); Brennan Dubord, Quesnel (CA); Jason Johnson, Quesnel (CA)

(73) Assignee: FPInnovations, Pointe-Claire (CA)

( * ) Notice: Subject to any disclaimer, the term of this patent is extended or adjusted under 35 U.S.C. 154(b) by 134 days.

(21) Appl. No.: 16/606,911

(22) PCT Filed: May 1, 2018

(86) PCT No.: PCT/CA2018/050512

§ 371 (c)(1),
(2) Date: Oct. 21, 2019

(87) PCT Pub. No.: WO2018/201241

PCT Pub. Date: Nov. 8, 2018

(65) Prior Publication Data

US 2021/0010200 A1 Jan. 14, 2021

Related U.S. Application Data

(60) Provisional application No. 62/500,679, filed on May 3, 2017.

(51) Int. Cl.

| | |
|---|---|
| ***D21C 11/12*** | (2006.01) |
| ***D21C 7/12*** | (2006.01) |
| ***D21C 11/00*** | (2006.01) |

(52) U.S. Cl.
CPC ..... *D21C 11/122* (2013.01); *D21C 7/12* (2013.01); *D21C 11/0064* (2013.01)

(58) Field of Classification Search
CPC ..... D21C 11/122; D21H 23/78
See application file for complete search history.

(56) References Cited

U.S. PATENT DOCUMENTS

| | | | |
|---|---|---|---|
| 5,213,663 | A | 5/1993 | Musow |
| 5,545,292 | A | 8/1996 | Empie |

(Continued)

FOREIGN PATENT DOCUMENTS

| | | |
|---|---|---|
| CA | 2138048 | 1/1994 |
| EP | 1193341 | 4/2002 |

(Continued)

OTHER PUBLICATIONS

Coyle et al., Improving Smelt Dissolving Tank TTA control at Zellstoff-Celgar, Jun. 2013, PacWest. (Year: 2013).*

(Continued)

*Primary Examiner* — Anthony Calandra
(74) *Attorney, Agent, or Firm* — Norton Rose Fulbright Canada LLP

(57) ABSTRACT

Methods and systems for controlling operation of a smelt dissolving tank receiving a flow of smelt and having a vent stack in fluid communication are provided. A dissolving liquid is injected into the smelt dissolving tank at a predetermined injection rate. A temperature of a flow of vapour in the vent stack is measured with a sensor. The injection rate of the dissolving liquid is controlled based on the temperature of the flow of vapour.

20 Claims, 5 Drawing Sheets

(56) References Cited

U.S. PATENT DOCUMENTS

| | | | | |
|---|---|---|---|---|
| 5,735,331 | A | 4/1998 | Engdahl et al. | |
| 2018/0080173 | A1* | 3/2018 | Koskinen ..... | D21C 11/122 |

FOREIGN PATENT DOCUMENTS

| | | |
|---|---|---|
| WO | 96/16225 | 5/1996 |
| WO | 00/73577 | 12/2000 |

OTHER PUBLICATIONS

Theilander, A system analysis of the chemical recovery plant of the sulphate pulping process, 1989, Nordic Pulp and Paper Research Journal, (4), p. 263-271 (Year: 1989).*

Laitinen. Kraft Recovery Boiler Dissolving Tank Mass and Energy Balance, 2016,Lappeenranta University of Technology (Year: 2016).*

Sanchez. Recausticizing—Principles and practice, 2008, KROS TAPPI. (Year: 2008).*

Cameron Hydraulic Data, 2002, Flowserve, 5:8-11 (Year: 2002).*

SCFM versus ACFM and ICFM, Mar. 28, 2015 [downloaded online Jan. 21, 2022], Engineering Toolbox [downloaded online from archive.org]. (Year: 2015).*

Theilander et al., A system analysis of the chemical recovery plant of the sulfate pulping process Part 7. Comments on the smelt dissolver,1999, Nordic Pulp and Paper Research Journal, No. 4 p. 263-271 (Year: 1999).*

Jin, E., "Smelt Droplet-Water Interaction in the Kraft Recovery Boiler Dissolving tank", Ph.D. Thesis, University of Toronto, 2017.

Jin et al., "Modeling of the Energy of a Smelt-Water Explosion in the Recovery Boiler Dissolving Tank", Tappi PEERS Conf., St. Louis, MO, Oct. 27-30, 2019.

* cited by examiner

VENT STACK TEMPERATURE AS A FEEDFORWARD VARIABLE FOR SMELT DISSOLVING TANK TTA CONTROL

CROSS-REFERENCE TO RELATED APPLICATIONS

The present application is a U.S. National Phase of International Application No. PCT/CA2018/050512, filed on May 1, 2018, and claiming priority from U.S. Provisional Application No. 62/500,679 filed May 3, 2017, the content of which is hereby incorporated by reference in its entirety.

TECHNICAL FIELD

The present disclosure relates generally to control systems, and more particularly to chemical recovery systems in the pulp and paper industry.

BACKGROUND

The role of a smelt dissolving tank (SDT) is to safely dissolve molten smelt from a recovery boiler in a dissolving liquid, such as weak wash. The amount of weak wash used in the SDT may be varied so that the density of the resultant raw green liquor is kept within desirable limits. SDT control is made difficult by the fact that the smelt flow is highly variable, subject to runoff in severe cases, and is difficult to control.

Traditionally, SDT control is effected based on properties of the green liquor, such as density or total titratable alkali (TTA). A density meter reacts to all the constituents in the green liquor, not just those associated with TTA. Therefore, constant density does not necessarily result in constant TTA. Ideally, the SDT control strategy should regulate the TTA to a target value while simultaneously ensuring that density stays within acceptable limits. A potential shortcoming of this strategy is that the amount of variability reduction that can be achieved by feedback control alone is fundamentally limited. That is, changes in density and TTA significantly lag smelt flow disturbances because the SDT volume is large relative to the nominal liquor flow rate, and this large hydraulic time constant limits the efficacy of the control.

As such, there is room for improved SDT control systems.

SUMMARY

In accordance with a broad aspect, there is provided a method for controlling operation of a smelt dissolving tank receiving a flow of smelt and having a vent stack in fluid communication, comprising: injecting, at a predetermined injection rate, a dissolving liquid into the smelt dissolving tank; measuring a temperature of a flow of vapour in the vent stack with a sensor; and controlling the injection rate of the dissolving liquid based on the temperature of the flow of vapour.

In some embodiments, the method further comprises: measuring at least one parameter of an output product of the smelt dissolving tank; and further adjusting the injection rate of the dissolving liquid based on the at least one parameter.

In some embodiments, the output product is green liquor.

In some embodiments, the at least one parameter comprises a density of the green liquor.

In some embodiments, the at least one parameter is a concentration of total titratable alkali in the green liquor.

In some embodiments, adjusting the injection rate comprises setting the injection rate between a predetermined minimum injection rate and a predetermined maximum injection rate.

In some embodiments, at least one of the minimum injection rate and the maximum injection rate is based on a safety requirement.

In some embodiments, the dissolving liquid is recycled water from a milling process.

In some embodiments, the sensor is located within the vent stack.

In some embodiments, the sensor is located at an output of the vent stack.

In accordance with another broad aspect, there is provided a system for controlling operation of a smelt dissolving tank receiving a flow of smelt and having a vent stack in fluid communication, comprising: a processing unit; and a non-transitory computer-readable memory having stored thereon program instructions. The program instructions are executable by the processing unit for: injecting, at a predetermined injection rate, a dissolving liquid into the smelt dissolving tank; measuring a temperature of a flow of vapour in the vent stack with a sensor; and controlling the injection rate of the dissolving liquid based on the temperature of the flow of vapour.

In some embodiments, the program instructions are further executable for: measuring at least one parameter of an output product of the smelt dissolving tank; and further adjusting the injection rate of the dissolving liquid based on the at least one parameter.

In some embodiments, the output product is green liquor.

In some embodiments, the at least one parameter comprises a density of the green liquor.

In some embodiments, the at least one parameter is a concentration of total titratable alkali in the green liquor.

In some embodiments, adjusting the injection rate comprises setting the injection rate between a predetermined minimum injection rate and a predetermined maximum injection rate.

In some embodiments, the dissolving liquid is recycled water from a milling process.

In some embodiments, the sensor is located within the vent stack.

In some embodiments, the sensor is located at an output of the vent stack.

In accordance with another broad aspect, there is provided a control system for a smelt dissolving tank receiving a flow of smelt and having a vent stack in fluid communication, comprising: a sensor configured to measure a temperature of a flow of vapour in the vent stack; and an injection rate controller configured to: receive a reading indicative of the temperature from the sensor; and control an injection rate of the dissolving liquid into the smelt dissolving tank based on the reading.

In accordance with a further broad aspect, the present disclosure is drawn to use of a temperature of vapour in a vent stack ("VST") of a smelt dissolving tank (SDT) to implement a feedforward control loop. The VST acts as a proxy variable for the unknown smelt flow, thereby enabling the use of feedforward control in addition to feedback control based on a density and/or a concentration of total titratable alkali in green liquor produced by the SDT. A temperature sensor is located in proximity to the vent stack, for example after a vent stack scrubber where the pressure is approximately atmospheric. The vapour is primarily a mixture of air and steam and has a nominal temperature somewhat less than the boiling point of water at atmospheric pressure. When the smelt flow increases, more steam is generated and this steam displaces air in the stack, thereby increasing the VST. When the smelt flow decreases, less steam is generated and the VST decreases. The changes in VST occur effectively simultaneous to the smelt flow changes and respond more quickly than the feedback control loop based on the density or concentration of total titratable alkali (TTA) of the green liquor produced by the SDT. Thus, a feedforward control loop based on changes in stack temperature act in a direct feedthrough manner to adjust the flow of dissolving liquid to the SDT.

BRIEF DESCRIPTION OF THE DRAWINGS

The invention will be described in greater detail with reference to the accompanying drawings, in which.

DETAILED DESCRIPTION

The role of a chemical recovery boiler in a kraft pulp mill is to burn black liquor, a by-product of a pulping process, to generate steam for use in the pulp mill and for electrical power generation. Additionally, the chemical recovery boiler is used to recover spent cooking chemicals, which are then recycled back into the pulping process. During the combustion process, the spent inorganic cooking chemicals in the black liquor form a molten smelt that collects on a floor of a recovery boiler.

Figure 1:
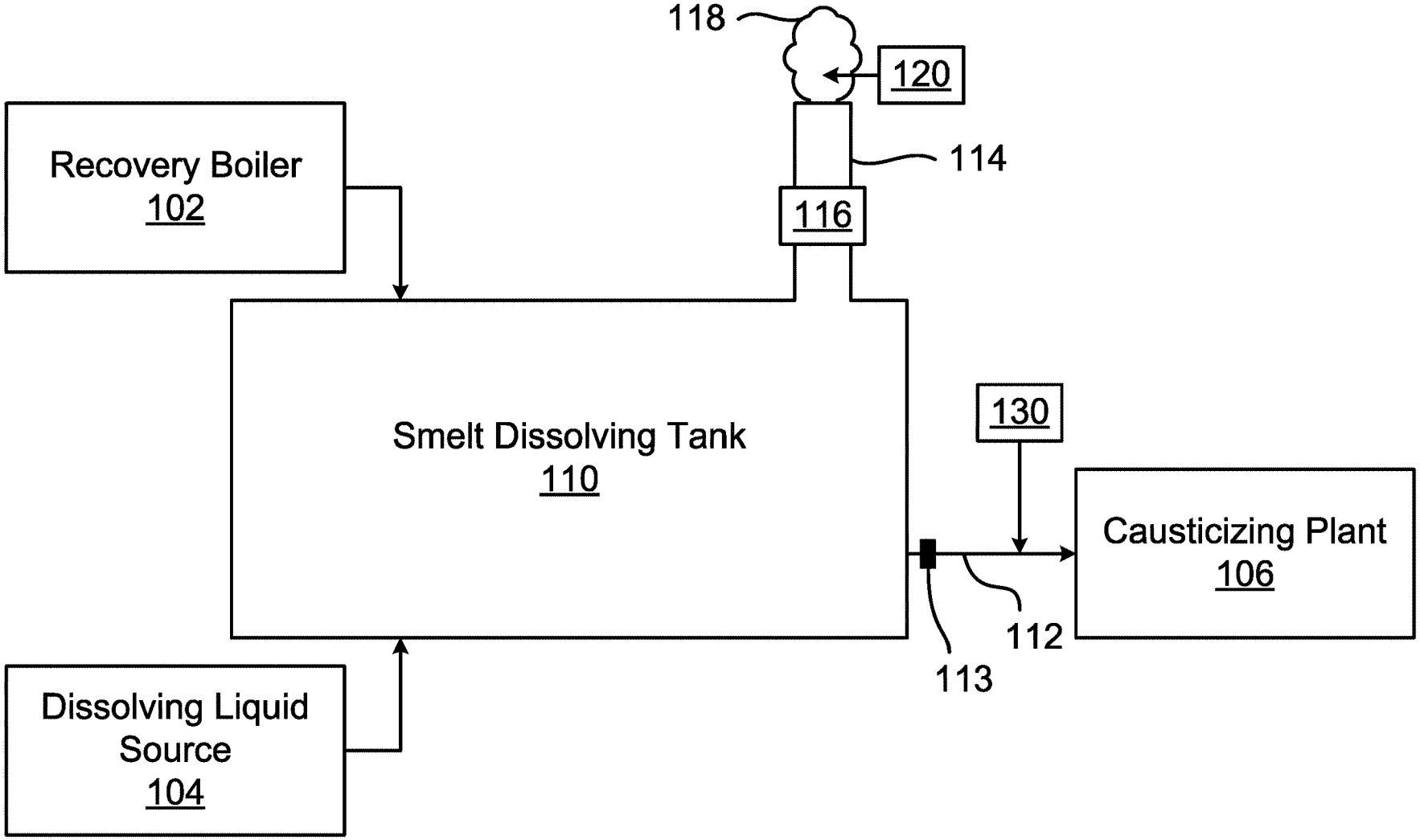
FIG. 1 is a block diagram of a portion of a pulp mill according to one embodiments described herein.

With reference to FIG. 1, the smelt, which collects in the recovery boiler 102, is discharged via gravity into a smelt dissolving tank 110 via a number of smelt spouts (not illustrated). The smelt is mainly composed of sodium carbonate and sodium sulfide, and may contain trace amounts of unburned char. The smelt is very hot, in some embodiments reaching temperatures of about 1000° C.: in some mills, the temperature of the smelt ranges from 750° C. to 1000° C.; in other mills, the temperature of the smelt ranges from 750° C. to 1200° C. Other temperature ranges for smelt are also considered.

In order to dissolve the smelt, the smelt dissolving tank 110 is provided with a reserve of a dissolving liquid. Additional dissolving liquid can be added to the smelt dissolving tank 110 from a dissolving liquid source 104. When the smelt comes into contact with the dissolving liquid, including the dissolving liquid in reserve in the dissolving tank 110 and/or the additional dissolving liquid provided by the dissolving liquid source 104, vapour 118 is produced within the smelt dissolving tank 110, which can be vented via a vent stack 114.

In some embodiments, the dissolving liquid is a weak wash obtained from a lime mud washer (not illustrated), which is fed into the smelt dissolving tank 110. In embodiments where the dissolving liquid is a weak wash, the composition of the weak wash can be similar to white liquor, but may be very dilute. In some embodiments, the weak wash has a concentration of total titratable alkali (TTA) between 25 and 40 g/L. The smelt dissolves in the weak wash to make raw green liquor, which has a concentration of TTA typically in the range 115 to 125 g/L. Other concentrations of TTA in the weak wash and green liquor are also considered. In other embodiments, the dissolving liquid includes fresh water, for example a mixture of fresh water and the aforementioned weak wash.

In some embodiments, the smelt dissolving tank 110 has an operating volume of approximately 30,000 US gallons and is agitated to help promote the dissolution process, though other volumes are also considered. The smelt dissolving tank 110 typically overflows to a standpipe that feeds into a raw green liquor transfer line, illustrated by arrow 112. In some embodiments, a transfer pump 113 is located in the transfer line 112. The transfer pump 113 transfers raw green liquor to a causticizing plant 106, where it is converted back into white liquor for use in later operations of the pulp mill. Certain volatile components, such as total reduced sulfur (TRS) and other particulates, may be collected from the smelt dissolving tank 110 and sent to a scrubber 116 located in the vent stack 114 to control gaseous emissions. Thus, the vapour 118 in the vent stack 114 is mainly composed of air and steam. The vapour 118 exiting the vent stack is vented to atmosphere. In some embodiments, the scrubber 116 is a wet scrubber.

The process by which the smelt is dissolved in the smelt dissolving tank 110 may be violent due to the temperature differential between the smelt and the dissolving liquid, which generates steam very rapidly. Additionally, the flow of smelt to the smelt dissolving tank 110 may be highly variable, and is difficult, or sometimes impossible, to control, as there is no control of the smelt flow from the recovery boiler 102. The variability of the rate of smelt flow into the smelt dissolving tank 110 in turn causes variability in the green liquor generation process.

In order to control operation of the smelt dissolving tank 110, a feedback control loop is implemented using any one or more of the density of the green liquor, the concentration of TTA in the green liquor, a conductivity of the green liquor, and a concentration of sodium carbonate in the green liquor. To measure the density of the green liquor, an in-line nuclear device installed in the raw green liquor transfer line 112 may be used. Alternatively, or in addition, a differential pressure measurement inside the smelt dissolving tank 110 may be performed. To measure the concentration of TTA, automatic titrators and/or liquor analysers may be used. In some embodiments, a Fourier Transform near-infrared (FT-NIR) liquor analyzer is used to measure the concentrations of any one or more of the following liquor constituents: sodium carbonate, sodium sulfide, sodium hydroxide, sodium sulfate and sodium thiosulfate.

In embodiments where the density and/or TTA concentration of the green liquor is measured in the transfer line 112, one or more sensors 130 are located in or proximate the transfer line 112. The sensors 130 may include the aforementioned in-line nuclear device, the automatic titrator, the liquor analyser, or any other suitable sensor. The sensors 130 may be located downstream of the transfer pump 113. In some embodiments, a sample line (not illustrated) is connected to the transfer line 112 in order to divert an amount of green liquor to the sensors 130. The sensors 130 sample and measure the constituents of the green liquor in the transfer line 112. In some embodiments, the sensors 130 analyze the green liquor periodically, in some embodiments every 35-40 minutes.

In addition, the operation of the smelt dissolving tank 110 may be controlled with a feedforward control loop based on the temperature of the vapour 118 exiting the vent stack 114. To measure the temperature of the vapour 118, sensors 120 are positioned near the vent stack 114, in some embodiments at an outlet thereof, where the vapour 118 exits the vent stack 114 to the atmosphere. In other embodiments, the sensors 120 are located within the vent stack 114, or alternatively are affixed to the vent stack 114, measuring the temperature of the vent stack 114 itself as a proxy for the temperature of the vapour 118 exiting the vent stack 114. The sensors 120 may be any suitable temperature sensor configured for measuring the temperature of the vapour 118.

Figure 2:
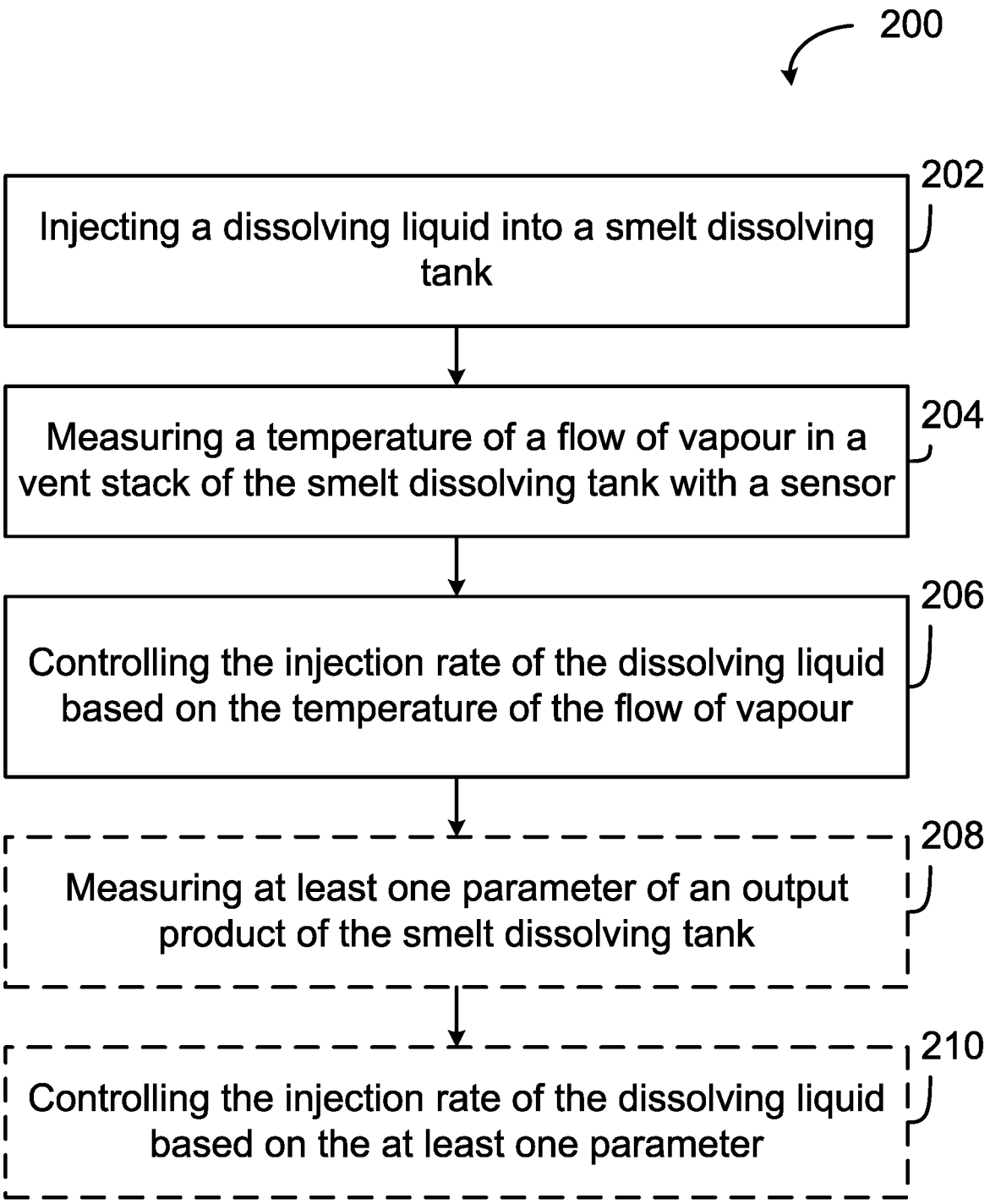
FIG. 2 is a flowchart illustrating an embodiment of a process for controlling operation of a smelt dissolving tank described herein.

With reference to FIG. 2, by using the feedback control loop based on the composition of the green liquor and the feedforward control loop based on the temperature of the vapour 118 exiting the vent stack 114, the operation of the smelt dissolving tank 110 may be controlled via a method 200. At step 202, a dissolving liquid, in some embodiments the weak wash, is injected into a smelt dissolving tank, for example the smelt dissolving tank 110. In some embodiments, the weak wash is provided by the dissolving liquid source 104, for example as a by-product of another step of the milling process, and thus is recycled water. In some embodiments, the dissolving liquid includes fresh water, and is a mixture of the recycled water from the milling process and fresh water. The dissolving liquid may be injected at any suitable rate, which may be a predetermined default or standard rate, or may be a rate based on some other previous determination.

At step 204, a temperature of a flow of vapour in a vent stack of the smelt dissolving tank 110, in some embodiments the vent stack 114, is measured. The temperature of the flow of vapour is measured by one or more sensors, in some embodiments the sensors 120. The temperature of the flow of vapour may be measured from within the vent stack 114, at an exhaust or output of the vent stack 114, or via a proxy measurement, in some embodiments by measuring a temperature of an outside surface of the vent stack 114.

At step 206, the injection rate of the dissolving liquid is controlled based on the temperature of the flow of vapour in the vent stack 114. In some embodiments, variations in the temperature of the flow of vapour elicit variations in the injection rate of the dissolving liquid. In some embodiments, a decrease in vapour flow temperature indicates a decrease in smelt flow: as a result, the injection rate of the dissolving liquid is reduced. Similarly, an increase in vapour flow temperature indicates an increase in smelt flow, and the injection rate of the dissolving liquid is increased in response.

Other control schemes are also considered. In some embodiments, recommended injection rates associated with smelt flow are used. The temperature of the flow of vapour in the vent stack 114 is indicative of the smelt flow, and the injection rate of the dissolving liquid is selected from the recommended injection rates based on the smelt flow. In some other embodiments, the injection rate of the dissolving liquid is provided with a minimum and/or a maximum flow rate, so that even if the temperature of the flow of vapour is indicative of smelt flow that would require an injection rate below the minimum and/or above the maximum flow rates, the injection rate is maintained between the minimum and/or maximum. In some embodiments, an alert is raised based on the temperature of the flow of vapour, for example if the temperature of the flow of vapour is indicative of smelt flow rates being above or below predetermined thresholds, which is associated with the maximum and/or minimum injection rates.

Steps 202 through 206 implement a feedforward control loop on the operation of the smelt dissolving tank 110, because the green liquor generation process is often quite time consuming: in some embodiments, a first-order lag of 2 to 4 hours may pass before a change in the injection rate of dissolving liquid effects a change in the composition of the green liquor. In contrast, changes in the temperature of the flow of vapour in the vent stack 114 are noticeable within much shorter delays, on the order of a few seconds or a few minutes. As a result, the operation of the smelt dissolving tank is altered during the production of the output product, namely the green liquor.

Optionally, a feedback control loop may also be implemented to further control the operation of the smelt dissolving tank 110. At step 208, at least one parameter of an output product of the smelt dissolving tank 110, in some embodiments the green liquor, is measured. In some embodiments, the parameter is a density of the green liquor. In other embodiments, the parameter is a concentration of TTA of the green liquor. In further embodiments, both the density and the concentration of TTA of the green liquor are measured. Still other parameters of the green liquor may be measured. The measuring of the parameter of the green liquor may be accomplished using any suitable sensor, in some embodiments by one or more of the sensors 130 described hereinabove.

At step 210, the injection rate of the dissolving liquid is further controlled based on the at least one parameter measured at step 208. In some embodiments, if the concentration of TTA in the green liquor is higher than a predetermined setpoint or range, the injection rate of dissolving liquid to the smelt dissolving tank 110 is increased. Similarly, if the density of the green liquor is higher than a predetermined setpoint or range, the injection rate of dissolving liquid to the smelt dissolving tank 110 is increased. Other adjustments to the injection rate may be made if the concentration of TTA and/or the density of the green liquor are below predetermined setpoints or ranges.

Steps 208 and 210 are optionally used to implement a feedback control loop to adjust the injection rate of dissolving liquor based on the output product of the smelt dissolving tank 110, which work in conjunction with the feedforward control loop based on the temperature of the flow of vapour in the vent stack 114. In this fashion, the smelt dissolving tank 110 is governed by both a feedforward control loop and a feedback control loop, which may lead to more stable green liquor production and cost savings for pulp mill operators.

Figure 3:
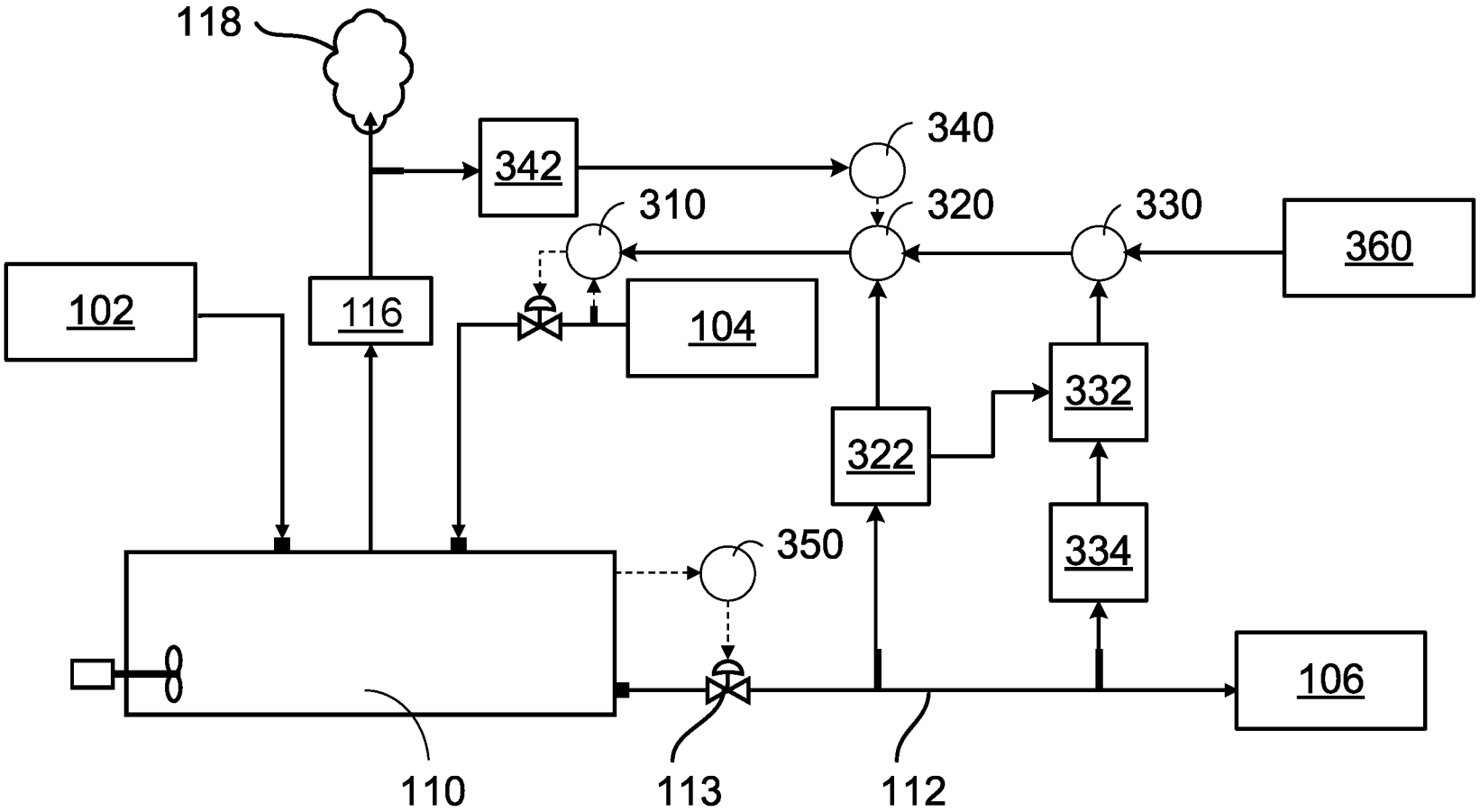
FIG. 3 is a simplified process schematic of an embodiment of a smelt dissolving tank described herein.

With reference to FIG. 3, in some embodiments the feedback control loop of the smelt dissolving tank 110 is implemented as a triple cascade. The innermost loop in the cascade is operated by a weak wash flow control 310, which controls the actual injection rate of weak wash into the smelt dissolving tank 110, in some embodiments from the dissolving liquid source 104. The middle loop in the cascade is operated by a density controller 320 which manipulates a setpoint of the weak wash flow controller 310 based on the density of the green liquor, obtained from a density sensor 322 connected to the transfer line 112. The outermost loop in the cascade is operated by a TTA feedback controller 330 which receives input from a TTA soft sensor 332, which in turn receives measurements from a TTA analyser 334. The TTA feedback controller 330 is configured for manipulating the setpoint of the density controller 320 by using the TTA soft sensor 332, which is configured to obtain the measured density from the density sensor 322 to predict the concentration of TTA in the green liquor between actual measurements by the TTA analyser 334. In some embodiments, the TTA analyser 334 may be a discrete TTA analyser which measures the concentration of TTA in the green liquor at predetermined sample times, and the TTA soft sensor 332 estimates the TTA concentration between the sample times.

The feedforward control loop is controlled by a temperature controller 340, which obtains a measurement of the temperature of the vent stack 114 from a temperature sensor 342. In some embodiments, changes in temperature of the vent stack 114 are multiplied by a static gain and are used to make substantially real-time adjustments to the weak wash flow setpoint via a direct feedthrough the density controller 320. In some embodiments, safe operation, for example in line with one or more safety requirements, is achieved by limiting the density setpoint to an allowable range through overrides. In addition, in some embodiments, a liquid level control 350 for the smelt dissolving tank 110 is configured for manipulating the flow rate of raw green liquor exiting the tank. In embodiments where no TTA analyser 334 is available, control of the smelt dissolve tank 110 is limited to density-based control only: the outermost loop in the cascade is omitted. This does not preclude the use of the temperature of the flow of vapour in the vent stack 114 for feedforward control. Additionally, in some embodiments a pulp mill controller 360 communicates with the TTA feedback controller 330 to set a TTA setpoint for the smelt dissolving plant 110. The pulp mill controller 360 may optionally communicate with any other suitable controllers, including the density controller 320, the temperature controller 340, and/or the liquid level control 350.

As described hereinabove, the temperature controller 340 applies a static gain to the temperature of the vent stack prior to feeding this value to the density controller 320. In order to determine the appropriate static gain, a dynamic model of the smelt dissolving tank 110 is developed, as discussed herein. The smelt dissolving tank 110 is assumed to be a continuously stirred tank reactor (CSTR). The molten smelt from the recovery boiler 102, which enters the smelt dissolving tank 110 at mass flow rate $M_s$, is assumed to contain only those chemical species which, when dissolved into solution, contribute to the TTA of the resultant raw green liquor. This assumption is reasonable since other green liquor constituents, such as sodium sulphate, sodium thiosulfate and sodium chloride, are typically present in relatively small concentrations (e.g.: 0-10 g/L). Thus, the units of $M_s$ are kg/min as $Na_2O$. The smelt dissolves in the dissolving liquid, in some embodiments weak wash, which enters the smelt dissolving tank 110 at volumetric flow rate $F_w$ and having a TTA concentration $C_w$ (kg/m$^3$ as $Na_2O$). The smelt dissolving tank 110 forms raw green liquor that exits the smelt dissolving tank 110 at flow rate $F_d$ and having a TTA concentration $C_d$ (also kg/m$^3$ as $Na_2O$). The temperature of the flow of vapour in the vent stack 114 is denoted $T_v$ and the volume of the smelt dissolving tank 110 is equal to $V_d$. Combining volumetric and material balances yields a nonlinear ordinary differential equation for the concentration of TTA in the raw green liquor:

$$V_d \cdot \frac{dC_d}{dt} = M_s + F_w(C_w - C_d) \quad [1]$$

The relationship between the concentration of TTA in the raw green liquor and the density of the raw green liquor may be approximated by a static linear relationship:

$$C_d = a \cdot D_d + b \quad [2]$$

where $D_d$ is dissolver density and parameters a and b are determined for a typical green liquor assuming a fixed liquor temperature of 95° C. Although the actual relationship is non-linear, and depends on liquor composition and temperature, a sensitivity analysis indicates that it is sufficient to use a single regression line to represent a mill's green liquor, provided the temperature is well controlled. A model based analysis is then used to calculate the feedforward gain.

Figure 4:
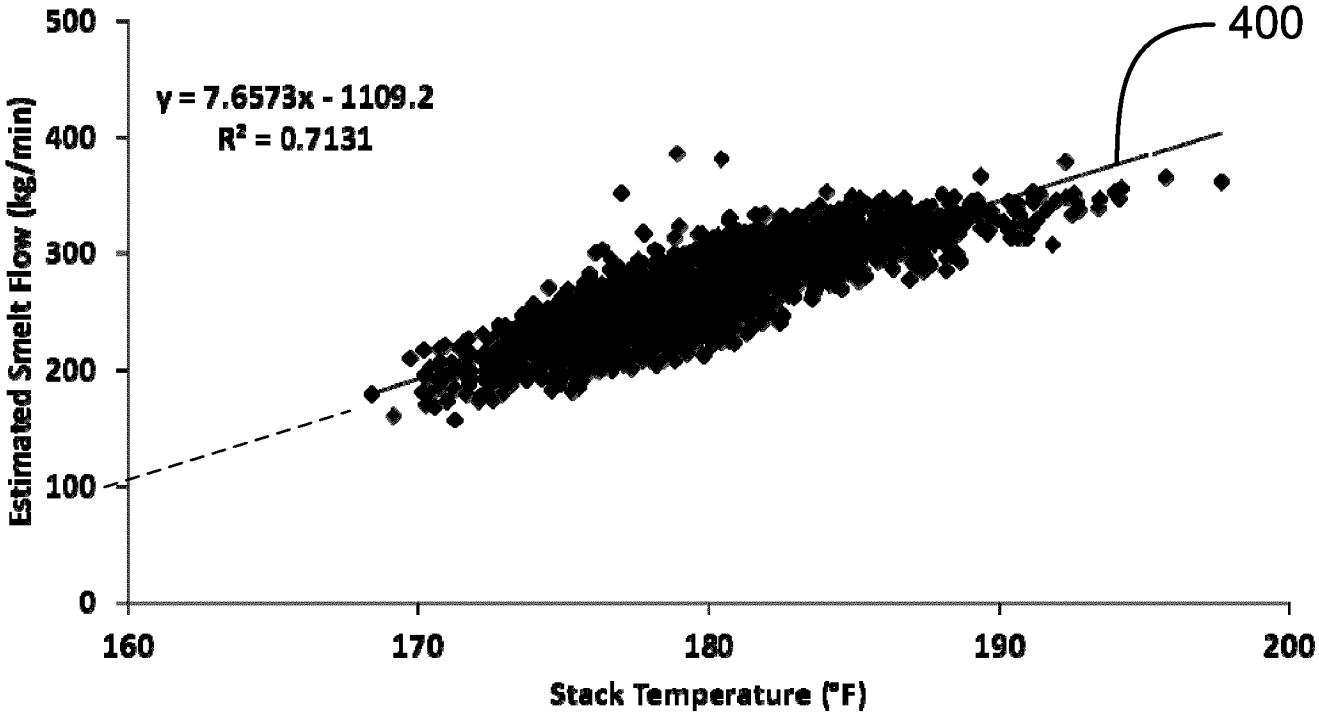
FIG. 4 is an estimated smelt flow plotted against dissolving tank vent stack temperature according to an embodiment described herein.

First, equations [1] and [2] above are used to calculate the unknown smelt flow into the smelt dissolving tank 110. In some embodiments, data from the smelt dissolving tank 110 is discretized at a one minute sampling interval then filtered and resampled at a lower rate to remove noise. A finite difference is used to approximate the derivative term. Second, and with reference to FIG. 4, the estimated smelt flow obtained from equations 1 and 2 is plotted against the temperature of the flow of vapour in the vent stack 114 and fit with a linear relationship 400. While the relationship between estimated smelt flow and the temperature of the flow of vapour in the vent stack may not be strictly linear, the linear relationship 400 serves as a useful approximation. The slope of the linear relationship 400 is denoted as $K_s$ in the following equation:

$$M_s = K_S \cdot T_v + y\text{-intercept} \quad [3].$$

Third, the feedforward controller gain $K_{FF}$ is obtained from:

$$K_{FF} = \frac{K_s}{C_d - C_w} \quad [4]$$

where nominal values are used for $C_d$ and $C_w$.

Figure 5:
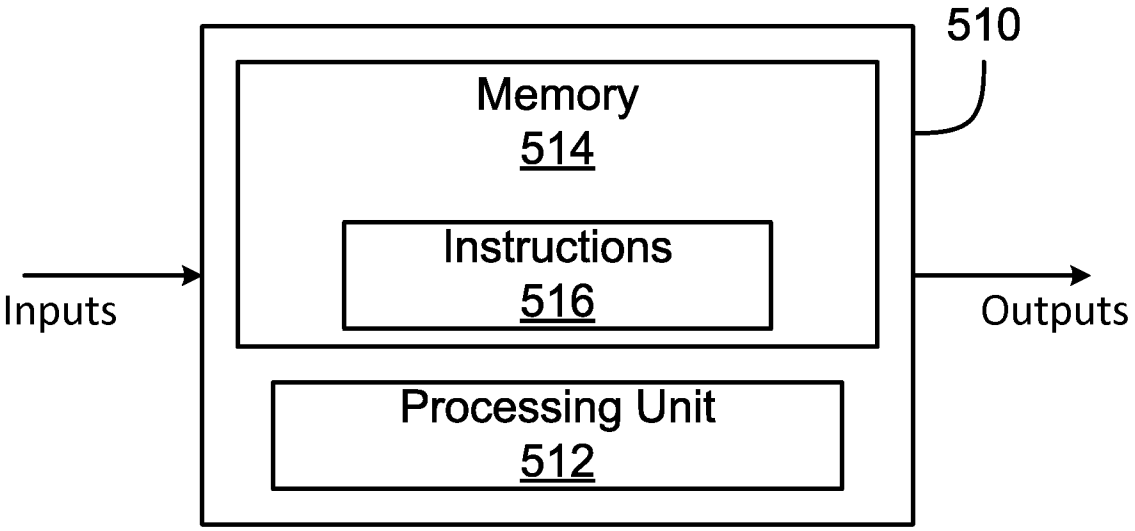
FIG. 5 is a schematic diagram of an embodiment of a computing system for implementing the process of FIG. 2 in accordance with an embodiment described herein.

With reference to FIG. 5, the method 200 may be implemented by a computing device 510, comprising a processing unit 512 and a memory 514 which has stored therein computer-executable instructions 516. The processing unit 512 may comprise any suitable devices configured to implement the method 200 such that instructions 516, when executed by the computing device 510 or other programmable apparatus, may cause the functions/acts/steps of the method 200 described herein to be executed. The processing unit 512 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 514 may comprise any suitable known or other machine-readable storage medium. The memory 514 may comprise non-transitory computer readable storage medium, for example, but not limited to, an electronic, magnetic, optical, electromagnetic, infrared, or semiconductor system, apparatus, or device, or any suitable combination of the foregoing. The memory 514 may include a suitable combination of any type of computer memory that is located either internally or externally to device, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Memory 514 may comprise any storage means (e.g., devices) suitable for retrievably storing machine-readable instructions 516 executable by processing unit 512.

In some embodiments, a single computing device, such as the computing device 510, can be used to implement any one or more of the aforementioned controllers, including the density controller 320, TTA feedback controller 330, the temperature controller 340, the liquid level control 350, and the pulp mill controller 360. In other embodiments, each of the density controller 320, TTA feedback controller 330, the temperature controller 340, the liquid level control 350, and the pulp mill controller 360 can be implemented by separate computing devices, such as the computing device 510.

In some embodiments, the computing device 510 is used to implement at least part of a control system for the smelt dissolving tank 110. The control system has a sensor, in some embodiments the sensors 120, and an injection rate controller, which is implemented by the computing device 510. The injection rate controller is configured for receiving a reading indicative of the temperature of the flow of vapour in the vent stack 114, which is obtained from the sensors 120. The injection rate controller is further configured for controlling the injection rate of the dissolving liquid into the smelt dissolving tank 110. In some embodiments, the injection rate controller implements at least some of the functionality assigned hereinabove to the density controller 320, TTA feedback controller 330, and the temperature controller 340.

The invention claimed is:

1. A method for controlling operation of a smelt dissolving tank receiving a flow of smelt and having a vent stack in fluid communication with the smelt dissolving tank, comprising:

injecting, at a predetermined injection rate, a dissolving liquid into the smelt dissolving tank;

measuring a temperature of a flow of vapour in the vent stack with a sensor; and controlling the injection rate of the dissolving liquid based on the temperature of the flow of vapour.

2. The method of claim 1, further comprising:

measuring at least one parameter of an output product of the smelt dissolving tank; and further adjusting the injection rate of the dissolving liquid based on the at least one parameter.

3. The method of claim 2, wherein the output product is green liquor.

4. The method of claim 3, wherein the at least one parameter comprises a density of the green liquor.

5. The method of claim 3, wherein the at least one parameter is a concentration of total titratable alkali in the green liquor.

6. The method of claim 1, wherein adjusting the injection rate comprises setting the injection rate between a predetermined minimum injection rate and a predetermined maximum injection rate.

7. The method of claim 6, wherein at least one of the minimum injection rate and the maximum injection rate is based on a safety requirement.

8. The method of claim 1, wherein the dissolving liquid is recycled water from a milling process.

9. The method of claim 1, wherein measuring the temperature with the sensor comprises measuring the temperature with the sensor located within the vent stack.

10. The method of claim 1, wherein measuring the temperature with the sensor comprises measuring the temperature with the sensor located at an output of the vent stack.

11. A system for controlling operation of a smelt dissolving tank, comprising:

the smelt dissolving tank receiving a flow of smelt and having a vent stack in fluid communication with the smelt dissolving tank;

a processing unit; and a sensor coupled to the processing unit, the sensor positioned at the vent stack of the smelt dissolving tank;

a non-transitory computer-readable memory having stored thereon program instructions executable by the processing unit for:

injecting, at a predetermined injection rate, a dissolving liquid into the smelt dissolving tank;

measuring a temperature of a flow of vapour in the vent stack with a sensor; and controlling the injection rate of the dissolving liquid based on the temperature of the flow of vapour.

12. The system of claim 11, wherein the program instructions are further executable for:

measuring at least one parameter of an output product of the smelt dissolving tank; and further adjusting the injection rate of the dissolving liquid based on the at least one parameter.

13. The system of claim 12, wherein the output product is green liquor.

14. The system of claim 13, wherein the at least one parameter comprises a density of the green liquor.

15. The system of claim 13, wherein the at least one parameter is a concentration of total titratable alkali in the green liquor.

16. The system of claim 11, wherein adjusting the injection rate comprises setting the injection rate between a predetermined minimum injection rate and a predetermined maximum injection rate.

17. The system of claim 11, wherein the dissolving liquid is recycled water from a milling process.

18. The system of claim 11, wherein the sensor is located within the vent stack.

19. The system of claim 11, wherein the sensor is located at an output of the vent stack.

20. A system comprising:

a smelt dissolving tank adapted to receive a flow of smelt;

a vent stack in fluid communication with the smelt dissolving tank;

a sensor positioned at the vent stack, configured to measure a temperature of a flow vapour in the vent stack; and an injection rate controller configured to:

receive a reading indicative of the temperature from the sensor; and control an injection rate of a dissolving liquid into the smelt dissolving tank based on the reading.

* * * * *